US009139009B2

(12) United States Patent
Nakashima et al.

(10) Patent No.: US 9,139,009 B2
(45) Date of Patent: Sep. 22, 2015

(54) LIQUID DISCHARGE APPARATUS

(71) Applicant: SEIKO EPSON CORPORATION, Tokyo (JP)

(72) Inventors: Hiromichi Nakashima, Nagano (JP); Jun Shimazaki, Nagano (JP); Noritaka Mitsuo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/972,111

(22) Filed: Aug. 21, 2013

(65) Prior Publication Data

US 2014/0063134 A1 Mar. 6, 2014

(30) Foreign Application Priority Data

Aug. 31, 2012 (JP) ..... 2012-192408

(51) Int. Cl.
*B41J 2/175* (2006.01)

(52) U.S. Cl.
CPC ..... *B41J 2/175* (2013.01)

(58) Field of Classification Search
USPC ..... 347/85
See application file for complete search history.

(56) References Cited

U.S. PATENT DOCUMENTS

| | | | | |
|---|---|---|---|---|
| 4,136,346 | A * | 1/1979 | Parkinson | 347/39 |
| 5,963,236 | A * | 10/1999 | Miyashita et al. | 347/85 |
| 2010/0110152 | A1* | 5/2010 | Nukui | 347/85 |
| 2011/0090270 | A1* | 4/2011 | Harada | 347/9 |
| 2011/0115844 | A1* | 5/2011 | Ozawa | 347/28 |

FOREIGN PATENT DOCUMENTS

| | | |
|---|---|---|
| JP | 2007-160749 A | 6/2007 |
| JP | 2010-089477 A | 4/2010 |

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

A liquid discharge apparatus includes a head configured and arranged to discharge a liquid including a sedimentary substance, and a liquid supply path for supplying the liquid from a liquid tank where the liquid is retained to the head. The liquid supply path has differences in elevation of a predetermined length or more in a vertical direction. The liquid supply path has a portion formed into a stepped shape and an angle formed by a width portion and a height portion in the portion formed into the stepped shape is 45 degrees or more and 90 degrees or less.

8 Claims, 5 Drawing Sheets

LIQUID DISCHARGE APPARATUS

CROSS-REFERENCE TO RELATED APPLICATIONS

This application claims priority to Japanese Patent Application No. 2012-192408 filed on Aug. 31, 2012. The entire disclosure of Japanese Patent Application No. 2012-192408 is hereby incorporated herein by reference.

BACKGROUND

1. Technical Field

The present invention relates to a liquid discharge apparatus.

2. Related Art

As a liquid discharge apparatus, there is known an ink jet printer which forms an image by discharging ink (one type of liquid) from a head. In such a printer, an ink supply path is provided where ink is supplied from an ink tank which retains ink to a head. In addition, as such a printer, a printer is known which uses an ink (referred to below as a sedimentary ink) which includes a sedimentary substance such as a white ink (for example, refer to Japanese Unexamined Patent Application Publication No. 2007-160749).

SUMMARY

However, in the printer which uses the sedimentary ink described above, when a part with a difference in elevation is included in the ink supply path, there is a concern that sediment of the sedimentary ink in such a part will become considerable and the sediment will be divided into portions with a high concentration and portions with a low concentration over a wide range. Due to this, there is a concern that it may be difficult to remove differences in concentration.

Therefore, the present invention has an object of facilitating removal of differences in concentration by dispersing sediment.

A liquid discharge apparatus according to one aspect includes a head configured and arranged to discharge a liquid including a sedimentary substance, and a liquid supply path for supplying the liquid from a liquid tank where the liquid is retained to the head. The liquid supply path has differences in elevation of a predetermined length or more in a vertical direction. The liquid supply path has a portion formed into a stepped shape and an angle formed by a width portion and a height portion in the portion formed into the stepped shape is 45 degrees or more and 90 degrees or less.

Other characteristics of the present invention will be clarified using description in the present specifications and attached diagrams.

BRIEF DESCRIPTION OF THE DRAWINGS

Referring now to the attached drawings which form a part of this original disclosure.

DETAILED DESCRIPTION OF EXEMPLARY EMBODIMENTS

At least the following items will be clarified using description in the present specifications and attached diagrams.

A liquid discharge apparatus according to one aspect includes a head configured and arranged to discharge a liquid including a sedimentary substance, and a liquid supply path for supplying the liquid from a liquid tank where the liquid is retained to the head. The liquid supply path has differences in elevation of a predetermined length or more in a vertical direction. The liquid supply path has a portion formed into a stepped shape and an angle formed by a width portion and a height portion in the portion formed into the stepped shape is 45 degrees or more and 90 degrees or less.

According to such a liquid discharge apparatus, it is possible to disperse the sediment inside the liquid supply path with the differences in elevation and it is possible to facilitate the removal of differences in concentration.

In the liquid discharge apparatus, it is preferable that the angle be 85 degrees or more and less than 90 degrees.

According to such a liquid discharge apparatus, it is possible to achieve optimization of the length of the liquid supply path and the removal of differences in concentration.

In the liquid discharge apparatus, it is preferable that the height portion is oriented along the vertical direction.

According to such a liquid discharge apparatus, it is possible to collect the sedimentary substance in the width portion of the steps.

In the liquid discharge apparatus, the liquid supply path may be formed by combining a first tube member with a linear shape and a second tube member with an L shape.

According to such a liquid discharge apparatus, it is possible to form the liquid supply path in a stepped shape.

In the liquid discharge apparatus, it is preferable that the liquid discharge apparatus has a fixing member and the liquid supply path be fixed using the fixing member.

According to such a liquid discharge apparatus, it is possible to reliably maintain the shape of the liquid supply path.

In the liquid discharge apparatus, the liquid supply path may be formed by a rigid body.

According to such a liquid discharge apparatus, it is possible to maintain the shape of the liquid supply path without using a member such as a fixing member.

In the liquid discharge apparatus, it is preferable that the liquid is a white ink.

According to such a liquid discharge apparatus, it is possible to facilitate the removal of differences in concentration even in a case of using a white ink which includes a pigment which easily becomes sediment.

Embodiment

Configuration Example of Printer

A configuration example of a printer 1 (in the present embodiment, an ink jet printer, in particular, a lateral scanning label printing machine) will be described as one example of the liquid discharge apparatus.

Figure 1:
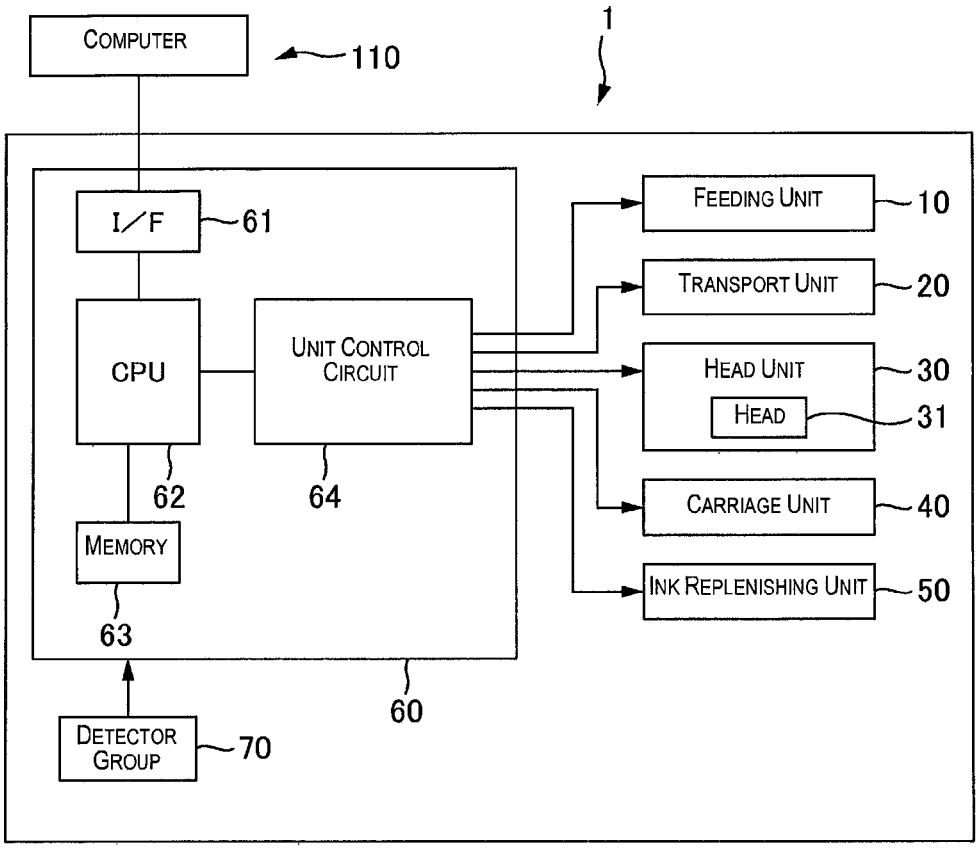
FIG. 1 is a block diagram illustrating a configuration example of a printer 1.

FIG. 1 is a block diagram illustrating a configuration example of the printer 1.

In addition, in the present embodiment, description will be given using a paper sheet (referred to below as roll paper (continuous paper)) which is wound into the shape of a roll as one example of a medium where the printer 1 records an image.

As shown in FIG. 1, the printer 1 according to the present embodiment has a feeding unit 10, a transport unit 20, a head unit 30, a carriage unit 40, an ink replenishing unit 50, a controller 60 which controls the above units and the like and governs the operations as the printer 1, and a detector group 70.

The feeding unit 10 feeds the roll paper to the transport unit 20. The feeding unit 10 has a roll paper shaft (which is not shown in the diagram), where the roll paper is wound and supported to be able to rotate, a roller (which is not shown in the diagram) for winding the roll paper which is drawn out from the roll paper shaft and guiding the roll paper to the transport unit 20, and the like.

The transport unit 20 transports the roll paper which is fed from the feeding unit 10 along a transport path which is set in advance. As a result, the transport unit 20 has a plurality of rollers (which are not shown in the diagram) which are provided along a transport path. Then, the transport path for transporting the roll paper is formed by moving the roll paper through each of the rollers successively. Here, the roll paper is intermittently transported by the transport unit 20 along the transport path in region units which correspond to the printing regions. In addition, the transport unit 20 has a platen (which is not shown in the diagram) which supports a part of the roll paper which is positioned in the printing region on the transport path.

The head unit 30 is for performing image printing on the roll paper by discharging a plurality of types of ink onto the printing region (which is on the platen) on the transport path. That is, an image is formed by the head unit 30 discharging ink from ink discharging nozzles onto the part of the roll paper which is fed into the printing region on the transport path by the transport unit 20. In the present embodiment, the head unit 30 has a plurality (M number) of heads 31.

Each of the heads 31 has an ink discharging nozzle row where ink discharging nozzles are lined up on the lower surface (that is, a nozzle surface) of the heads 31. In the present embodiment, there are nozzle rows which are each formed of a plurality of ink discharging nozzles #1 to #N for each of the colors of yellow, magenta, cyan, black, white, and the like. Here, in the following description, each of the yellow, magenta, cyan, and black inks is also referred to as a color ink. In addition, the white ink is also referred to as white ink.

Each of the nozzles #1 to #N in each of the nozzle rows is aligned in a linear shape in an intersecting direction (also referred to below as a width direction) which intersects with the transport direction of the roll paper. Each of the nozzle rows is arranged to be parallel and to be spaced from each other along the transport direction.

Each of the nozzles #1 to #N is provided with a piezo element (which is not shown in the diagram) as a driving element for discharging ink droplets. When a voltage is applied between electrodes which are provided at both ends of the piezo element with a predetermined time width, the piezo element expands and contracts according to the application time of the voltage and a side wall of the ink flow path changes its shape. Due to this, the volume of the ink flow path contracts according to the expansion and contraction of the piezoelectric element and the ink which corresponds to the extent of the contraction becomes ink droplets and is discharged from each of the nozzles #1 to #N for each of the colors.

Then, the M heads 31 are lined up in the width direction, and due to this, the head unit 30 is formed. As a result, the head unit 30 has M×N nozzles for each of the colors.

The carriage unit 40 is for moving the head unit 30 (each of the heads 31). The carriage unit 40 has a carriage guide rail (which is not shown in the diagram) which extends in the transport direction, a carriage (which is not shown in the diagram) which is supported so as to be able to reciprocally move in the transport direction along the carriage guide rail, and a motor (which is not shown in the diagram) which drives the carriage.

The head unit 30 (each of the heads 31) is provided in the carriage. Then, the carriage is configured so as to be integral with the head unit 30 and to move in the transport direction due to the driving of the motor which is not shown in the diagram.

The ink replenishing unit 50 is for supplying ink to the head unit 30 when the amount of ink inside the head unit 30 is decreased due to the discharging of the ink.

The ink replenishing unit 50 is configured from ink cartridges, a large number of tubes which are the flow path (the pathway) for the ink, a large number of valves for opening and closing these tubes, and the like. Here, the details of the ink replenishing unit 50 will be described later.

The controller 60 is a control unit for performing control of the printer 1. As shown in FIG. 1, the controller 60 has an interface section 61, a CPU 62, a memory 63, and a unit control circuit 64. The interface section 61 is for performing transmission and reception of data between a computer 110 which is an external apparatus and the printer 1. The CPU 62 is a computation processing apparatus for performing control of the entire printer 1. The memory 63 is for securing a region for storing programs for the CPU 62, a working region, and the like. The CPU 62 controls each of the units using the unit control circuit 64 which follows the programs which are stored in the memory 63.

The detector group 70 monitors the circumstances inside the printer 1 and, for example, includes a detecting sensor which detects slack in the roll paper, a rotary encoder which is attached to the transport roller and which is used in controlling of the transport of the roll paper and the like, a paper detection sensor which detects the presence or absence of the roll paper to be transported, a linear encoder for detecting a position of the carriage (the head 31) in the transport direction, a paper end position detection sensor which detects the paper end (edge) position in the width direction (the intersecting direction) of the roll paper, and the like.

Printing Operation

The overall operation of the printer 1 will be described. In the printer 1 according to the present embodiment, the controller 60 performs each of the processes by controlling the control targets (the feeding unit 10, the transport unit 20, the head unit 30, the carriage unit 40, and the ink replenishing unit 50) in accompaniment with computer programs which are stored in the memory 63. Accordingly, the computer programs have code for controlling the control targets in order to execute these processes.

In detail, in the printing process, the controller 60 performs reception of print commands, a paper feeding operation, a dot forming operation, a transport operation, a paper discharge determination, and a printing completion determination. Below, each of the processes will be described in a simple manner.

The reception of the print command is a process where a print command is received from the computer 110. In this process, the controller 60 receives the print command via the interface section 61.

The paper feeding operation is an operation where the roll paper which is the target to be printed on is moved along the transport path and positional alignment is performed at a printing start position (a so-called cue position). In the operation, the controller 60 moves the roll paper by driving a transport motor.

The dot forming operation is an operation for forming dots on the roll paper. In the operation, the controller 60 drives the carriage by controlling the carriage unit 40 and outputs a control signal with regard to each of the heads 31 of the head unit 30. At this time, ink is discharged from each of the nozzles by a driving signal being applied to the piezo elements. Due to this, ink is intermittently discharged from each of the nozzles during the movement of the carriage (the heads 31) and dots are formed on the roll paper.

The transport operation is an operation where the roll paper is moved intermittently in the transport direction. The controller 60 intermittently transports the roll paper along the transport path (the transport direction) for every predetermined transport amount (a transport amount which is equivalent to one page) by controlling the transport unit 20. Due to this, it is possible to form dots in the next dot forming operation at positions which are different to the dots which were formed by the previous dot forming operation.

The printing completion determination is determination of whether or not to continue the printing. The controller 60 performs the print completion determination based on the presence or absence of print data with regard to the roll paper which is the target to be printed on.

White Ink

The printer 1 of the present embodiment uses white ink along with the color inks (yellow, magenta, cyan, and black).

The white ink is ink for printing, for example, a background color (white) in a color image when performing printing on a transparent medium. In this manner, it is easy for the color image to be seen due to the background being white. Here, the white ink contains a white pigment (which corresponds to a sedimentary substance) as a colorant. Examples of the white pigment are, for example, metal oxides, barium sulfate, calcium carbonate, and the like. Examples of the metal oxides are, for example, titanium dioxide, zinc oxide, silica, alumina, magnesium oxide, and the like. Out of these, titanium dioxide is preferable from the point of view of a superior white color. It is easy for the white ink to become thicker and solidify when stored for a long period of time. In addition, the white ink is a sedimentary ink which has a property where it is easy for the pigment to become sediment when stored for a long period of time. Here, sedimentary ink is ink where the light absorption is 95% or less over 24 hours.

Ink Replenishing Unit 50

Figure 2:
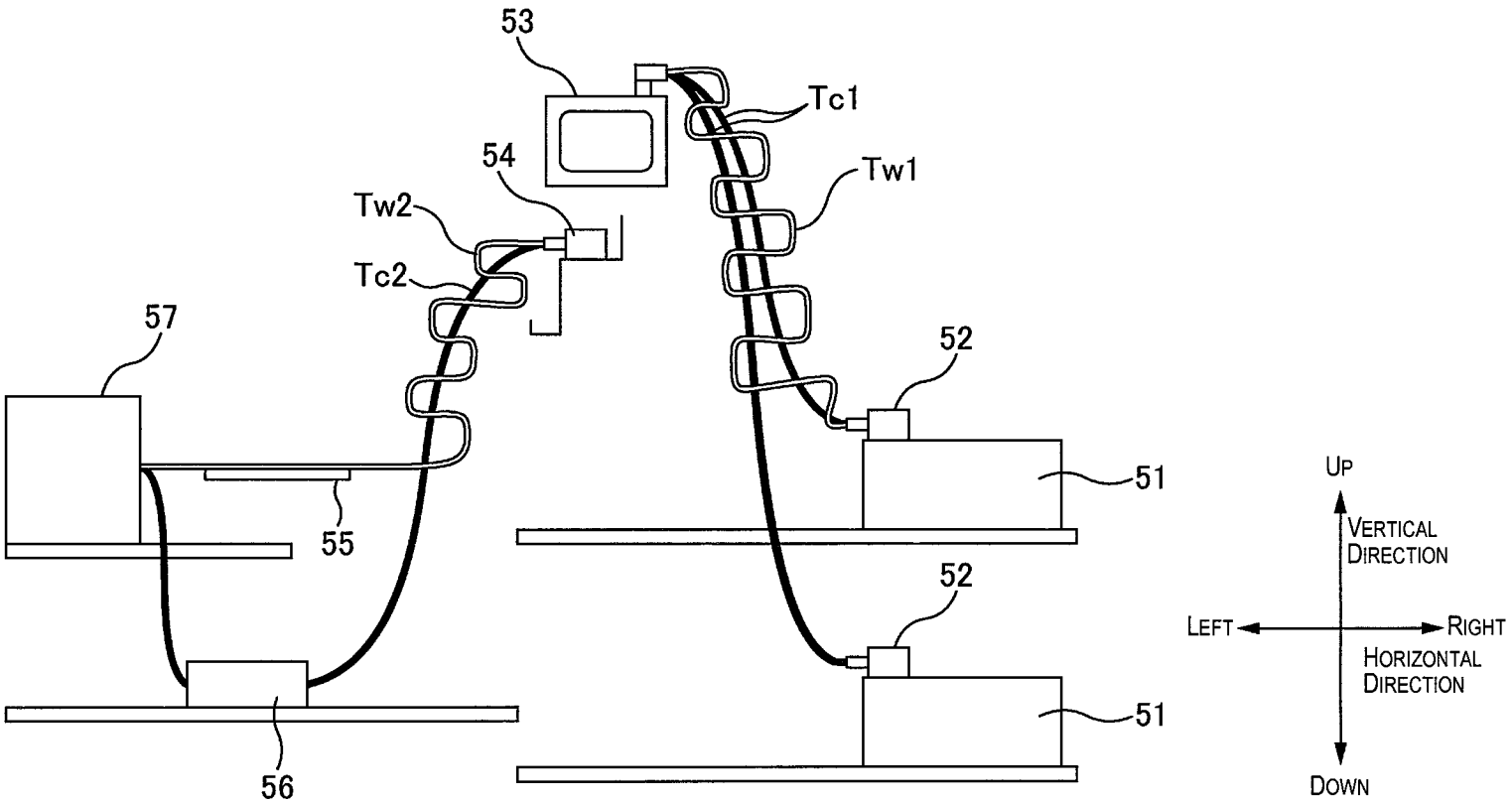
FIG. 2 is an explanatory diagram of a configuration example of an ink replenishing unit 50.

FIG. 2 is an explanatory diagram of a configuration example of the ink replenishing unit 50. Here, in the following description, in a case of referring to the "vertical (up and down) direction" and the "horizontal (left and right) direction", directions are shown by arrows in the diagram as a reference.

The ink replenishing unit 50 of the present embodiment has an ink cartridge accommodating section 51, a cartridge side solenoid valve 52, a relay tank 53, a relay tank side solenoid valve 54, a holding platform 55, a cable duct 56, and a Cableveyor (registered trademark) 57.

Here, in the ink replenishing unit 50 which is provided with the above, for convenience of description, the flow path of the white ink in the ink supply tube which is disposed from the ink cartridge accommodating section 51 to the relay tank 53 is set as an ink supply tube Tw1, and the other (the color ink) flow path is set as an ink supply tube Tc1. In addition, the flow path of the white ink in the ink supply tube which is disposed from the relay tank 53 to the inlet of the Cableveyor (registered trademark) 57 is set as the ink supply tube Tw2, and the other (the color ink) flow path is set as an ink supply tube Tc2.

Here, the ink cartridge accommodating section 51 and the relay tank 53 correspond to the liquid tank, and the ink supply tubes Tc1, Tw1, Tc2, and Tw2 correspond to the liquid supply path.

The ink cartridge accommodating section 51 is a portion which accommodates (that is, retains the inks) the ink cartridges of the inks of each of the colors and is arranged at the bottom right in the diagram, and in the present embodiment, the ink cartridge accommodating section 51 is provided with a two step configuration of an upper step and a lower step and a plurality of ink cartridges are each attached to the ink cartridge accommodating section 51. The ink cartridge accommodating section 51 pumps the ink inside the ink cartridges to the relay tank 53 using a pump which is not shown in the diagram. Here, the ink cartridge with the white ink is attached to the ink cartridge accommodating section 51 of the upper step side. This is in order to reduce the distance (the difference in elevation) to the relay tank 53 as will be described later. The ink cartridges with the color inks are each attached to the upper step or the lower step of the ink cartridge accommodating section 51 at predetermined positions.

The cartridge side solenoid valve 52 is attached to the ink cartridge accommodating section 51 and opens and closes the flow paths of the ink supply tubes Tc1 and Tw1 due to controlling by the controller 60. The supply of ink from the ink cartridge accommodating section 51 to the relay tank 53 is controlled by this opening and closing. In each of the ink cartridge accommodating sections 51, a plurality of cartridge side solenoid valves 52 are provided to correspond to the ink cartridges (the ink colors) which are attached. Each of the ink supply tubes Tc1 and Tw1 is shown by one line in the diagrams, but in practice, a plurality of the ink supply tubes Tc1 and Tw1 are each provided to correspond to the plurality of cartridge side solenoid valves 52. Here, in the present embodiment, tubes are used as the ink supply tubes Tc1 and Tw1.

The relay tank 53 is provided between the ink cartridge accommodating section 51 and the Cableveyor (registered trademark) 57 at a position (the upper side in the vertical direction) which is higher than the ink cartridge accommodating section 51 and the Cableveyor (registered trademark) 57. This is because the ink is supplied using the differences in the level of liquids in the head unit 30. Each of the inks which are supplied from the ink cartridge accommodating section 51 to the relay tank 53 is retained in regions which are partitioned for each type of ink.

The relay tank side solenoid valve 54 is provided at a lower section of the relay tank 53 and opens and closes the flow paths of the ink supply tubes Tc2 and Tw2 due to controlling by the controller 60. Here, the ink supply tubes Tc2 and Tw2 are shown by a single line in the diagrams, but in practice, a plurality of the ink supply tubes Tc2 and Tw2 are provided for each of the colors of ink. In addition, a plurality of the relay tank side solenoid valves 54 are also provided to correspond to the ink supply tubes Tc2 and Tw2.

The cable duct 56 is bundled such that the plurality of ink supply tubes Tc2 for the color inks does not slip and is provided at a position (the lower side) which is lower than the Cableveyor (registered trademark) 57 between the relay tank 53 and the Cableveyor (registered trademark) 57. Here, this is because arranging the cable duct 56 at this position (a position which is lower than the Cableveyor (registered trademark) 57) facilitates maintenance.

The Cableveyor (registered trademark) 57 is able to move in the manner of a caterpillar so as to follow the movement of the carriage. The Cableveyor (registered trademark) 57 is provided at a position which is below and to the left of the relay tank 53 and is above and to the left of the cable duct 56. The ink supply tubes Tc2 and Tw2 of each of the colors are held inside the Cableveyor (registered trademark) 57 and are able to move within a predetermined range. Then, each of the ink supply tubes passes through the Cableveyor (registered trademark) 57 and is connected to the head 31 of the carriage unit 40.

The holding platform 55 is provided at a position (the upper side) which is higher than the cable duct 56 at the lower side of the relay tank 53, and is a member for guiding the ink supply tube Tw2 with the white ink from the relay tank 53 to the Cableveyor (registered trademark) 57 by supporting the ink supply tube Tw2 at a predetermined position in the vertical direction.

Flow Path of White Ink

As shown in FIG. 2, differences in elevation are generated in the printer 1 of the present embodiment in the ink flow path from the ink cartridge accommodating section 51 to the carriage (the head unit 30). As described above, since the white ink which is used in the present embodiment includes a pigment (a sedimentary substance) which easily becomes sediment, there is a concern that the sediment may become considerable in locations where the difference in elevation is large when the flow path of the white ink is formed in the same manner as the color ink.

Therefore, in the printer 1 of the present embodiment, the differences in elevation of the flow paths (the ink supply tubes Tw1 and Tw2) with the white ink which easily becomes sediment are reduced as much as possible. In detail, the white ink is supplied from the upper step side of the ink cartridge accommodating section 51 to the relay tank 53 (the cartridge with the white ink is set to the upper step side of the ink cartridge accommodating section 51). Due to this, the differences in elevation are reduced compared to the differences in elevation up to the ink cartridge accommodating section 51 which is the lower step side and the relay tank 53.

In addition, in the flow path from the relay tank 53 to the Cableveyor (registered trademark) 57, the ink supply tube Tw2 with the white ink passes above the holding platform 55 without passing through the cable duct 56. Due to this, for the flow path (the ink supply tube Tw2) of the white ink, the differences in elevation are reduced compared to the flow path (the ink supply tube Tc2) of the color ink.

In addition, in the present embodiment, in a portion where it is not possible to reduce the differences in elevation (where there are differences in elevation), the flow path (the ink supply tubes Tw1 and Tw2) of the white ink as shown in FIG. 2 is provided in a stepped shape. In detail, as shown in FIG. 2, the ink supply tube Tw1 between the ink cartridge accommodating section 51 and the relay tank 53 and the ink supply tube Tw2 between the relay tank 53 and the holding platform 55 are provided in a stepped shape.

Figure 3A:
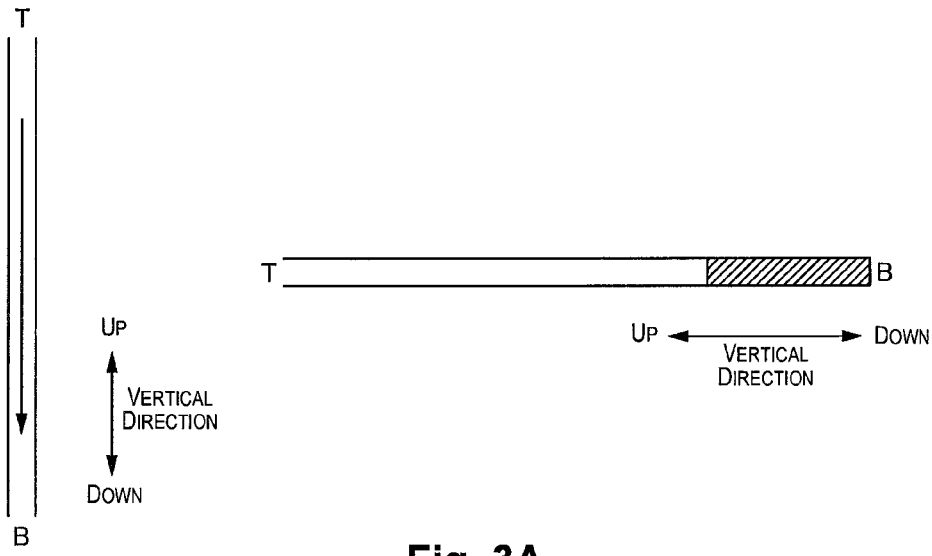
FIG. 3A and FIG. 3B are conceptual diagrams for describing a relationship between the shape of an ink flow path and a sediment state of a white ink.
Figure 3B:
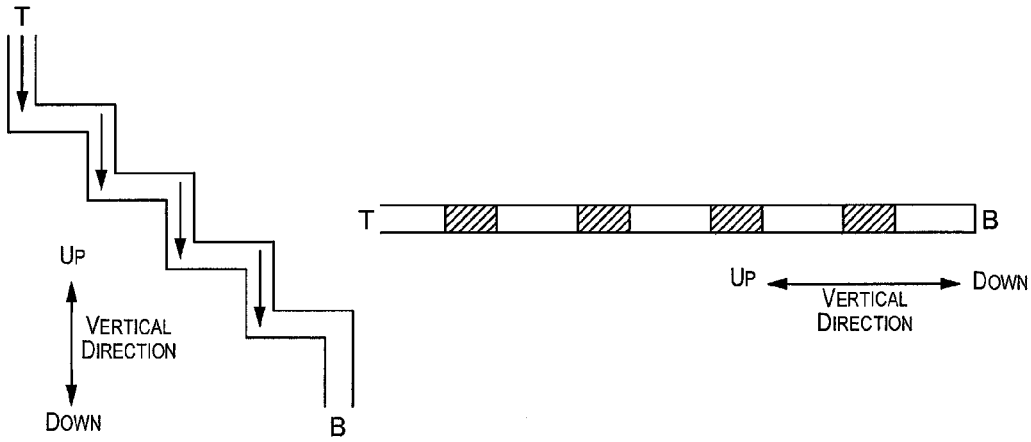

FIG. 3A and FIG. 3B are conceptual diagrams for describing a relationship between the shape of an ink flow path and a sediment state of the white ink. FIG. 3A shows a case where the flow path of the white ink is a linear shape and FIG. 3B shows a case where the flow path of the white ink is a stepped shape. Here, the portion of the flow path in the height direction is along the vertical direction. In addition, the left side of the diagram shows the sediment of the white ink (the pigment) and the right side of the diagram shows the state of the distribution of high and low concentration when the flow path is assumed to be linear. The diagonal line portion of the diagram is a portion with a high concentration and the white portion is a portion with a low concentration. Here, in a case where the differences in elevation are the same, the ink flow path is longer with a stepped shape than with a linear shape, but the lengths are shown to be the same.

In a case where the ink flow path is a linear shape, the pigment of the white ink becomes sediment at the lower side in the vertical direction and is divided into portions with a high concentration and portions with a low concentration over a wide range as shown in the right side of FIG. 3A. As a result, for example, portions with a high concentration and portions with a low concentration do not mix together easily and are difficult to stir even when a circulation flow path which is not shown in the diagram is provided at an upper end T and a lower end B and the ink is circulated using a circulation pump or the like. That is, it is difficult to remove differences in concentration.

On the other hand, when the ink flow path is a stepped shape, many of the portions with a high concentration and the portions with a low concentration are formed since the sediment is dispersed as shown in FIG. 3B. In other words, the interfaces (boundaries) between the portions with a high concentration and the portions with a low concentration are numerous compared to FIG. 3A. As such, for example, when a circulation flow path which is not shown in the diagram is provided at the upper end T and the lower end B and the ink is circulated using a circulation pump or the like, it is easier for the portions with a high concentration and the portions with a low concentration to be mixed together than in the case of FIG. 3A. That is, it is easy to remove differences in concentration compared to the case of a linear shape.

For these reasons, in the present embodiment, the ink supply tubes (Tw1 and Tw2) with the white ink are provided in a stepped shape in a part with a difference in elevation as described above. With this arrangement, ink sediment is dispersed in a plurality of locations in the part with the differences in elevation. Here, the stepped shape may be formed in a portion of the portions with differences in elevation.

Figure 4:
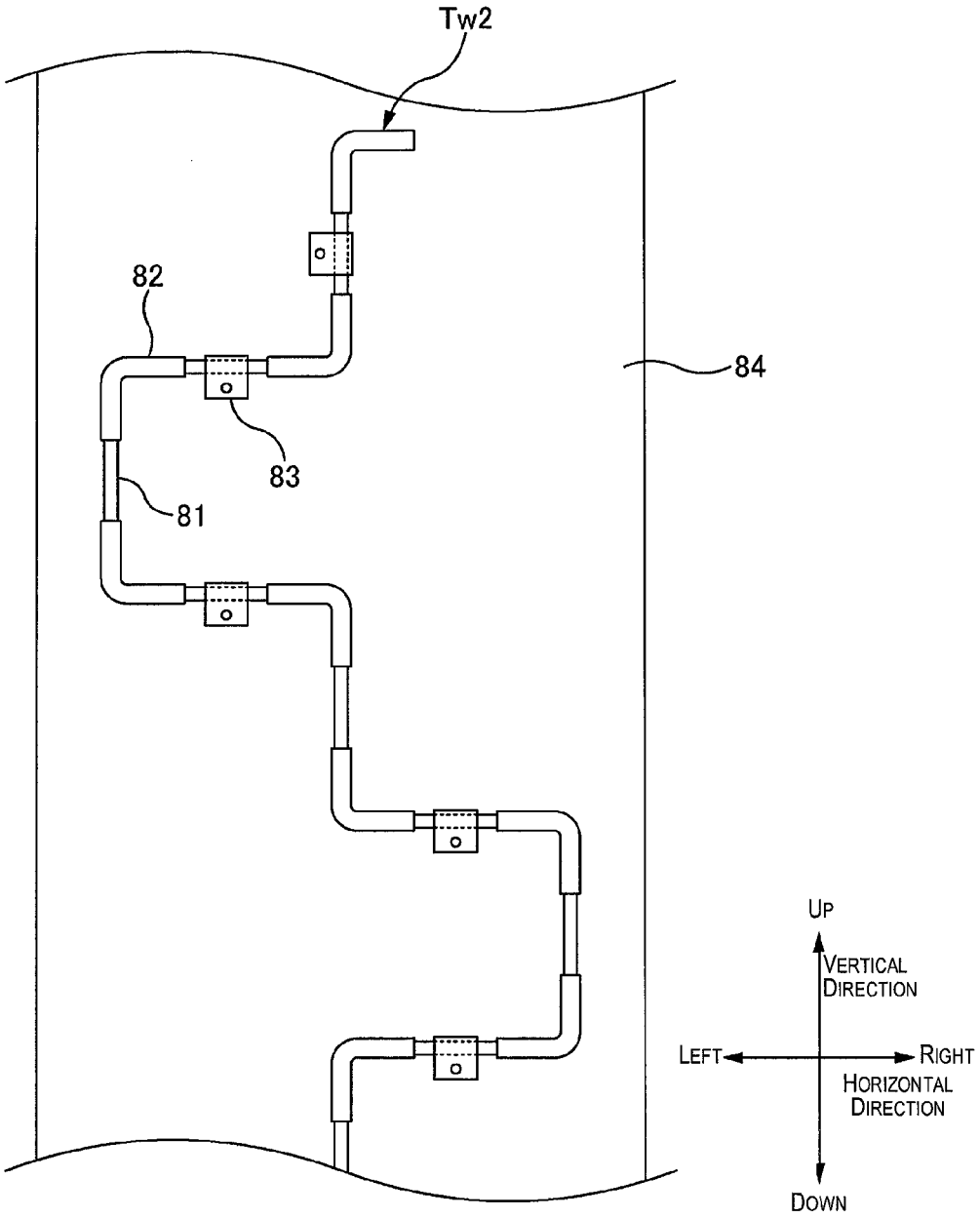
FIG. 4 is an explanatory diagram of a configuration of an ink supply tube Tw2.

FIG. 4 is an explanatory diagram of a configuration of the ink supply tube Tw2. Here, the ink supply tube Tw1 also has the same configuration.

As shown in FIG. 4, the ink supply tube Tw2 of the present embodiment is formed in a stepped shape by combining a plurality of tubes 81 with a linear shape (which correspond to the first tube member) and a plurality of tubes 82 with an L shape (which correspond to the second tube member). Here, for example, the tube 81 is inserted into the tube 82 using ethanol or the like.

In addition, the ink supply tube Tw2 is fixed to an attachment plate 84 by a clamp 83.

The attachment plate 84 (which corresponds to the fixing member) is, for example, a plate-shaped member which is made of aluminum and is for fixing the ink supply tube Tw2.

The clamp 83 is a tool for fixing by securing the tubes 81 of the ink supply tube Tw2 to the attachment plate 84 with screws or the like. With this arrangement, it is possible for each of the tubes 81 to not fall due to its own weight and it is possible to reliably maintain the stepped shape. In addition, it is possible to suppress deterioration over time of the shape of the ink supply tube Tw2 which has the stepped shape. Here, in the present embodiment, the tubes 81 with a linear shape are fixed, but the present invention is not limited to this, and the tubes 82 may be fixed. Alternatively, both the tubes 81 and the tubes 82 may be fixed.

Here, the diameter of each of the tubes which are used in the present embodiment is 3 mm and the dimensions of each step in the steps (length in the vertical direction) are 50 to 70 mm. For example, six steps are formed when there is a difference in elevation of 330 mm and seven steps are formed when there is a difference in elevation of 410 mm.

Angle of Stepped Shape

Figure 5A:
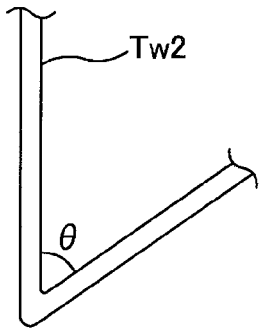
FIG. 5A to FIG. 5C are explanatory diagrams of a case where an angle of a stepped portion of the ink supply tube Tw2 is changed.
Figure 5B:
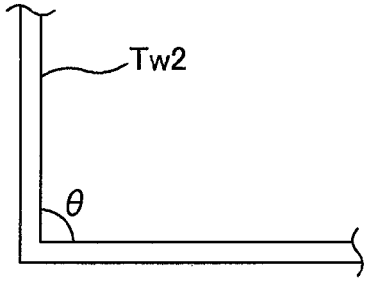
Figure 5C:
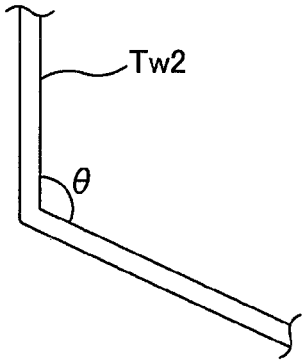
Figure 5C:
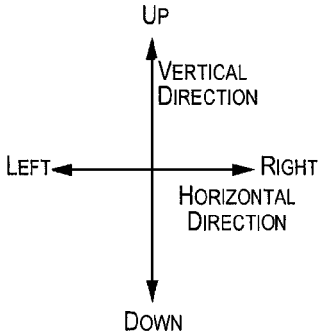

FIG. 5A to FIG. 5C are explanatory diagrams of a case where an angle of a stepped portion of the ink supply tube Tw2 is changed. Here, in the present embodiment, a height portion (a portion in the up and down direction) of the steps is along the vertical direction. In addition, in each of the diagrams, the tube 81 and the tube 82 of the ink supply tube Tw2 are shown in an integrated manner and the angle which is formed by the width portion (the left and right direction) and the height portion (the up and down direction) of the steps is set as 0.

FIG. 5A illustrates a case where the angle θ is an acute angle (less than 90 degrees). In this case, the white ink (in detail, the white pigment) becomes sediment in a portion (a lower section in the vertical direction) which is bent into a V shape. As a result, it is possible to keep the pigment in the bent portion and it is possible to prevent the pigment from flowing downward. However, when the angle is set to be too small (for example, less than 45 degrees), this is not preferable because the ink flow paths which are provided are lengthened with regard to the predetermined differences in elevation and loss in pressure when the ink is supplied due to differences in the level of liquids is increased. As such, it is sufficient if the angle θ is set to 45 degrees or more.

FIG. 5B illustrates a case where the angle θ is 90°. Even in this case, since the pigment becomes sediment in an L-shaped bent portion, it is possible to keep the pigment in this portion. In addition, it is possible to shorten the ink flow path which is provided with regard to the predetermined differences in elevation compared to the case of FIG. 5A. That is, in a case where the angle θ is 90 degrees (FIG. 5B), it is possible to reduce the loss in pressure compared to a case where the angle θ is less than 90 degrees (FIG. 5A).

FIG. 5C illustrates a case where the angle θ is an obtuse angle (which is greater than 90 degrees). In this case, it is not possible to keep the pigment in the bent portion and the pigment flows downward in the vertical direction. Thus, it is not possible to disperse the ink sediment. As such, the concentration of the ink in the lower side portion of the part with differences in elevation is high even with a stepped shape. That is, since the range where high and low concentrations are generated is widened (the number of interfaces of high and low concentration is reduced), it is difficult to remove differences in concentration.

Due to the above, it is preferable that the angle θ between the width portion and the height portion of the steps be set to 45 degrees or more and 90 degrees or less. It is more preferable that the angle be just less than 90 degrees. In the present embodiment, considering variations in manufacturing, the angle θ is set to 85 degrees or more and less than 90 degrees (the design value of the angle θ is set to 87 degrees). By doing so, it is possible to achieve optimization of the length of the flow path of the white ink (in other words, the loss in pressure) and the removal of differences in concentration.

Here, in the present embodiment, the ink supply tube Tw2 has been described but the same applies to the ink supply tube Tw1.

It is possible to disperse the ink sediment at each of the locations in the steps by forming the ink supply tubes Tw1 and Tw2 which are the parts with differences in elevation in this manner with a stepped shape and setting the angle θ between the width portion and the height portion of the steps to 45 degrees or more and less than 90 degrees. Due to this, since the range where high and low concentrations are generated is narrowed and the interfaces between the portions with a high concentration and the portions with a low concentration are increased, it is possible to facilitate the removal of differences in concentration by stirring or the like.

As described above, the printer 1 of the present embodiment is provided with the head 31 which discharges the white ink which has a sedimentary substance and the ink supply tubes Tw1 and Tw2 for supplying the white ink from the white ink cartridge (the ink cartridge accommodating section 51) to the head 31 via the relay tank 53, where the flow path of the white ink has a part with differences in elevation of a predetermined length (for example, 100 mm) or more in the vertical direction. In the present embodiment, the ink supply tubes Tw1 and Tw2 of the white ink are formed in a stepped shape in the parts with these differences in elevation, and the angle which is formed by the width portion and the height portion of the ink supply tubes Tw1 and Tw2 is set to 45 degrees or more and 90 degrees or less.

With this arrangement, it is possible to reliably disperse the sediment of the white ink in the stepped portion in the parts with differences in elevation, and it is possible to disperse the sediment at locations where there are differences in concentration (it is possible to increase the number of interfaces between the portions with a high concentration and the portions with a low concentration). Due to this, it is possible to facilitate the removal of differences in concentration.

Other Embodiments

The embodiment described above is for easy understanding of the present invention and is not to be interpreted as limiting the present invention. It goes without saying that the present invention is able to be achieved by modifications or alteration without departing from the gist of the invention and substitutes are included in the present invention. In particular, the embodiments described later are also included in the present invention.

Printer

In the embodiment described above, the printer has been described as one example of the liquid discharge apparatus but the liquid discharge apparatus is not limited to this. For example, the same technique as the present embodiment may be applied to various types of liquid discharge apparatuses where an ink jet technique is applied such as a color filter manufacturing apparatus, a dyeing apparatus, a micro-processing apparatus, a semiconductor manufacturing apparatus, a surface processing apparatus, a three dimensional molding apparatus, a liquid vaporizing apparatus, an organic EL manufacturing apparatus (in particular, a polymer EL manufacturing apparatus), a display manufacturing apparatus, a film forming apparatus, or a DNA chip manufacturing apparatus.

In addition, in the embodiment described above, the printer was a lateral scanning printer, but the present invention is not limited to this. For example, the printer may be a printer (a so-called serial printer) which forms an image by alternately repeating a dot forming operation where a dot row is formed along a movement direction which intersects with a nozzle row direction while the head unit is moved in the movement direction and a transport operation (a movement operation) where the medium is transported in a transport direction which is the nozzle row direction. In addition, for example, the printer may be a printing apparatus (a so-called line printer) where a head which is longer than the paper width is fixed above the transport path and printing is performed on the medium by ink being intermittently discharged from the head while the medium is transported in the transport direction. In addition, for example, the printer may be a printer where a plurality of heads are arranged so as to face a circumferential surface of a cylindrical transport drum and an image is formed by ink being discharged from each of the heads onto the medium while transporting the medium along the circumferential surface of the transport drum.

Medium

In the embodiment described above, description was given with the roll paper as an example of the medium, but the medium is not limited to this. For example, the medium may be cut paper, film, or cloth.

Discharge Method

In the embodiment described above, ink was discharged using a piezoelectric element (a piezo element). However, the method of discharging the liquid is not limited to this. For example, other methods may be used, such as a method where bubbles are generated inside the nozzles using heat.

Ink

In the embodiment described above, ink was used as the liquid since the embodiment was a printer, but the liquid which is discharged from the nozzles is not limited to such inks. For example, a liquid (also including water) which includes a metal material, an organic material (in particular, a polymer material), a magnetic material, a conductive material, a wiring material, a film forming material, an electronic ink, a working fluid, a gene solution, or the like may be discharged from the nozzles. Also in this case, it is sufficient if the supply path of the liquid is configured as in the embodiment described above for the liquid which includes the sedimentary substance.

In addition, ultraviolet curing ink (UV ink) which is cured by irradiation of ultraviolet rays (UV) may be used as the ink.

In addition, an image may be formed also using inks other than yellow, cyan, magenta, and black (for example, light cyan, light magenta, green, orange, and the like) as the color inks.

Ink Supply Tube

In the embodiment described above, tubes (the tube 81 and the tube 82) were used in the ink supply tubes Tw2 with a stepped shape and fixed to the attachment plate 84 by the clamp 83, but the present invention is not limited to this. For example, the ink supply tube Tw2 may be formed in a stepped shape with a rigid body (for example, a metal (such as aluminum), ceramics, glass, or the like). In this case, it is possible to realize the stepped shape without using the attachment plate 84. Here, the same applies to the ink supply tube Tw1.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:

a head configured and arranged to discharge a liquid;

a first liquid supply path configured and arranged to supply a first liquid from a liquid tank where the first liquid is retained to the head, the first liquid supply path having differences in elevation of a predetermined length or more in a vertical direction, and the first liquid supply path having a portion formed in a stepped shape; and a second liquid supply path configured and arranged to supply a second liquid from a liquid tank where the second liquid is retained to the head, the first liquid supply path having reduced differences in elevation in the vertical direction compared to the second liquid supply path, and the portion formed in the stepped shape being disposed in a region of the first liquid supply path having differences in elevation, and the portion formed in the stepped shape including a plurality of width portions and a plurality of height portions alternately arranged with an angle formed by adjacent ones of the width portions and the height portions being 45 degrees or more and 90 degrees or less.

2. The liquid discharge apparatus according to claim 1, wherein the angle is 85 degrees or more and less than 90 degrees.

3. The liquid discharge apparatus according to claim 1, wherein the height portions are oriented along the vertical direction.

4. The liquid discharge apparatus according to claim 1, wherein the first liquid supply path is formed by combining a first tube member with a linear shape and a second tube member with an L shape.

5. The liquid discharge apparatus according to claim 4, further comprising a fixing member, wherein the first liquid supply path is fixed using the fixing member.

6. The liquid discharge apparatus according to claim 1, wherein the first liquid supply path is formed by a rigid body.

7. The liquid discharge apparatus according to claim 1, wherein the first liquid is white ink.

8. The liquid discharge apparatus according to claim 1, wherein the plurality of width portions include at least two pairs of a first width portion and a second width portion, with the first width portion and the second width portion being configured and arranged such that a flow direction of the first liquid in the first width portion is substantially opposite from a flow direction of the first liquid in the second width portion.

* * * * *